US010074306B2

(12) United States Patent
Kim et al.

(10) Patent No.: US 10,074,306 B2
(45) Date of Patent: Sep. 11, 2018

(54) REMOTE COMPENSATION SERVICE METHOD, REMOTE COMPENSATION SERVICE SYSTEM, OLED DISPLAY DEVICE, AND REMOTE COMPENSATION SERVER

(71) Applicant: LG Display Co., Ltd., Seoul (KR)

(72) Inventors: Woojoon Kim, Paju-si (KR); Taro Hasumi, Seoul (KR); Kwangjoon Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 28 days.

(21) Appl. No.: 15/288,708

(22) Filed: Oct. 7, 2016

(65) Prior Publication Data

US 2017/0124947 A1 May 4, 2017

(30) Foreign Application Priority Data

Nov. 3, 2015 (KR) ..... 10-2015-0153693

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2320/0233* (2013.01); *G09G 2320/0295* (2013.01); *G09G 2320/045* (2013.01); *G09G 2320/048* (2013.01); *G09G 2320/0693* (2013.01); *G09G 2370/022* (2013.01)

(58) Field of Classification Search
CPC ..... G09G 3/3233; G09G 2320/0693; G09G 2320/048; G09G 2320/045; G09G 2320/0233; G09G 2300/0842; G09G 2370/022
See application file for complete search history.

(56) References Cited

U.S. PATENT DOCUMENTS

2005/0088379 A1* 4/2005 Tsuchida ..... G09G 3/3258 345/76
2005/0237318 A1* 10/2005 Inoue ..... G09G 5/003 345/207
2011/0205250 A1* 8/2011 Yoo ..... G09G 3/3233 345/690
2012/0229526 A1* 9/2012 Holmes ..... G06F 3/14 345/690
2015/0022512 A1* 1/2015 Ahn ..... G09G 3/3607 345/212
2016/0210903 A1* 7/2016 Jun ..... G09G 3/3266

* cited by examiner

*Primary Examiner* — Mihir K Rayan
(74) *Attorney, Agent, or Firm* — Fenwick & West LLP

(57) ABSTRACT

A method of compensating for changes in characteristics of a panel of a display device is disclosed. The panel includes subpixels, each of the subpixels including an organic light emitting diode. The method comprises: counting, by the display device, at least one on-time of at least one subpixel of the subpixels, the at least one on-time indicating a number of occurrences of light emitted by the at least one subpixel; transmitting, by the display device, the at least one on-time to a remote compensation server through a network; determining, by the remote compensation server, an organic light emitting diode compensation factor based on the at least one on-time; transmitting, by the remote compensation server, the organic light emitting diode compensation factor to the display device through the network; and driving, by the display device, the panel based on the organic light emitting diode compensation factor.

17 Claims, 12 Drawing Sheets

REMOTE COMPENSATION SERVICE METHOD, REMOTE COMPENSATION SERVICE SYSTEM, OLED DISPLAY DEVICE, AND REMOTE COMPENSATION SERVER

CROSS REFERENCE TO RELATED APPLICATION

This application claims priority from Korean Patent Application Number 10-2015-0153693 filed on Nov. 3, 2015, which is hereby incorporated by reference for all purposes as if fully set forth herein.

BACKGROUND

Field

The present disclosure relates to compensation technologies for organic light-emitting diode (OLED) display devices.

Description of Related Art

Organic light-emitting display devices, also referred to as organic light-emitting diode (OLED) display devices, have recently come to prominence as next generation display devices. Such OLED display devices have inherent advantages, such as relatively fast response speeds and wide viewing angles, since OLEDs able to emit light by themselves are used therein.

Such an OLED display device includes a matrix of subpixels, each of which has an OLED, and controls the levels of brightness of subpixels selected by scanning signals based on the grayscales of data.

In this regard, in an OLED display panel (or an organic light-emitting display panel) of an OLED display device, circuit elements, such as an OLED and a transistor and a capacitor for driving the OLED, are disposed in each of the subpixels.

In addition, in the OLED display panel, circuit elements, such as an OLED and a transistor, may undergo degradations in quality along with the lapse of driving time, thereby changing characteristics thereof.

This may consequently cause differences in characteristics between circuit elements in subpixels. Differences in characteristics between circuit elements may cause differences in luminance between subpixels, thereby acting as a major reason for lowering image quality.

In this regard, the development of a variety of compensation technologies for reducing differences in characteristics between circuit elements in an OLED display panel has been undertaken.

Such a variety of compensation technologies require additional components with high processing ability for the addition of compensation functions.

However, implementing additional components with high processing ability is cost inefficient.

SUMMARY

In one embodiment, a method of compensating for changes in characteristics of a panel of a display device is disclosed. The panel includes a plurality of subpixels, each of the plurality of subpixels including an organic light emitting diode. The method comprises: counting, by the display device, at least one on-time of at least one subpixel of the plurality of subpixels, the at least one on-time indicating a number of occurrences of light emitted by the at least one subpixel; transmitting, by the display device, the at least one on-time to a remote compensation server through a network; determining, by the remote compensation server, an organic light emitting diode compensation factor based on the at least one on-time; transmitting, by the remote compensation server, the organic light emitting diode compensation factor to the display device through the network; and driving, by the display device, the panel based on the organic light emitting diode compensation factor.

In one or more embodiments, the method further comprises generating, by the remote compensation server, an organic light emitting diode degradation look up table. The organic light emitting diode compensation factor may be determined by applying the at least on-time to the organic light emitting diode degradation look up table.

In one or more embodiments, the method further comprises sensing, by the display device, a voltage or current; generating, by the display device, sensing data indicative of a characteristic of the at least one subpixel based on the sensed voltage or the sensed current; transmitting, by the display device, the sensing data to the remote compensation server through the network; determining, by the remote compensation server, a transistor compensation factor based on the sensing data; transmitting, by the remote compensation server, the transistor compensation factor to the display device; and wherein the panel is driven further based on the transistor compensation factor.

In one or more embodiments, a display device is disclosed. The display device includes: a panel including a plurality of subpixels, each of the plurality of subpixels including an organic light emitting diode; a counter coupled to the panel, the counter to obtain at least one on-time of at least one subpixel of the plurality of subpixels, the at least one on-time indicating a number of occurrences of light emitted by the at least one subpixel; a communication circuit coupled to the counter and a network, the communication circuit configured to: transmit, the at least one on-time to a remote server through the network, and receive, an organic light emitting diode compensation factor through the network, the organic light emitting diode compensation factor generated by the remote server based on the at least one on-time; a compensator circuit coupled to the communication circuit, the compensator circuit configured to generate compensated image data based on the organic light emitting diode compensation factor; and a driver circuit coupled to the compensator circuit and the panel, the driver configured to drive the panel based on the compensated image data.

In one or more embodiments, the compensator circuit is configured to generate the compensated image data based on the organic light emitting diode compensation factor to compensate for a change in a threshold voltage of the organic light emitting diode.

In one or more embodiments, the display device further includes a sensor coupled to the plurality of subpixels, the sensor configured to generate sensing data indicative of a characteristic of the at least one subpixel.

The communication circuit may be further configured to: transmit the sensing data to the remote server through the network, and receive a transistor compensation factor through the network, the transistor compensation factor generated by the remote server based on the sensing data.

The compensator circuit may be configured to generate the compensated image data further based on the transistor compensation factor.

The at least one subpixel may include a driving transistor, and the compensator circuit may be configured to generate the compensated image data further based on the transistor compensation factor to compensate for a change in a threshold voltage or a mobility of the driving transistor. The driving transistor may supply current to the organic light emitting diode of the at least one subpixel for emitting light. The sensor may be configured to sense a saturated voltage of an electrode of the driving transistor changing from a reference voltage. The sensing data may include a value of the saturated voltage indicative of the threshold voltage of the driving transistor. The sensor may be configured to sense a voltage of an electrode of the driving transistor for a predetermined amount of time after a reference voltage is provided to the electrode. The sensing data may include a value of the sensed voltage, a rate of change from the reference voltage to the sensed voltage indicative of the mobility of the driving transistor.

In one or more embodiments, the display device further comprises a memory coupled to the communication circuit, the memory to store the organic light emitting diode compensation factor.

The communication circuit may be further configured to transmit product identification information or panel identification information to the remote server through the network. The organic light emitting diode compensation factor may be generated by the remote server based on the product identification information or the panel identification information.

In one embodiment, a method performed by a remote server for compensating for changes in characteristics of a panel in a display device through a network is disclosed. The panel includes a plurality of subpixels, each of the plurality of subpixels including an organic light emitting diode. The method comprises: receiving, from the display device and through the network, at least one on-time of a subpixel of the plurality of subpixels, the at least one on-time indicating a number of occurrences of light emitted by the subpixel; determining an organic light emitting diode compensation factor based on the at least one on-time; and transmitting the organic light emitting diode compensation factor to the display device through the network.

The at least one on-time may indicate the number of occurrences of light emitted by the at least one subpixel for a gray level.

The organic light emitting diode compensation factor may indicate an amount of compensation corresponding to a change in a threshold voltage of the organic light emitting diode of the subpixel. The organic light emitting diode compensation factor is determined by applying the at least one on-time to an organic light emitting diode degradation look up table.

In one or more embodiments, the method further comprises: receiving, from the display device and through the network, product identification information or panel identification information; and selecting the organic light emitting diode degradation look up table from amongst a plurality of organic light emitting diode degradation look up tables based on the product identification information or the panel identification information.

In one or more embodiments, the method further comprises receiving sensing data indicative of a characteristic of a driving transistor of the subpixel through the network; determining a transistor compensation factor based on the sensing data; and transmitting the determined transistor compensation factor to the display device. The transistor compensation factor transmitted to the display device may indicate an amount of compensation corresponding to a change in a threshold voltage or a mobility of the driving transistor. The driving transistor may supply current to the organic light emitting diode of the subpixel for emitting light.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION

Figure 1:
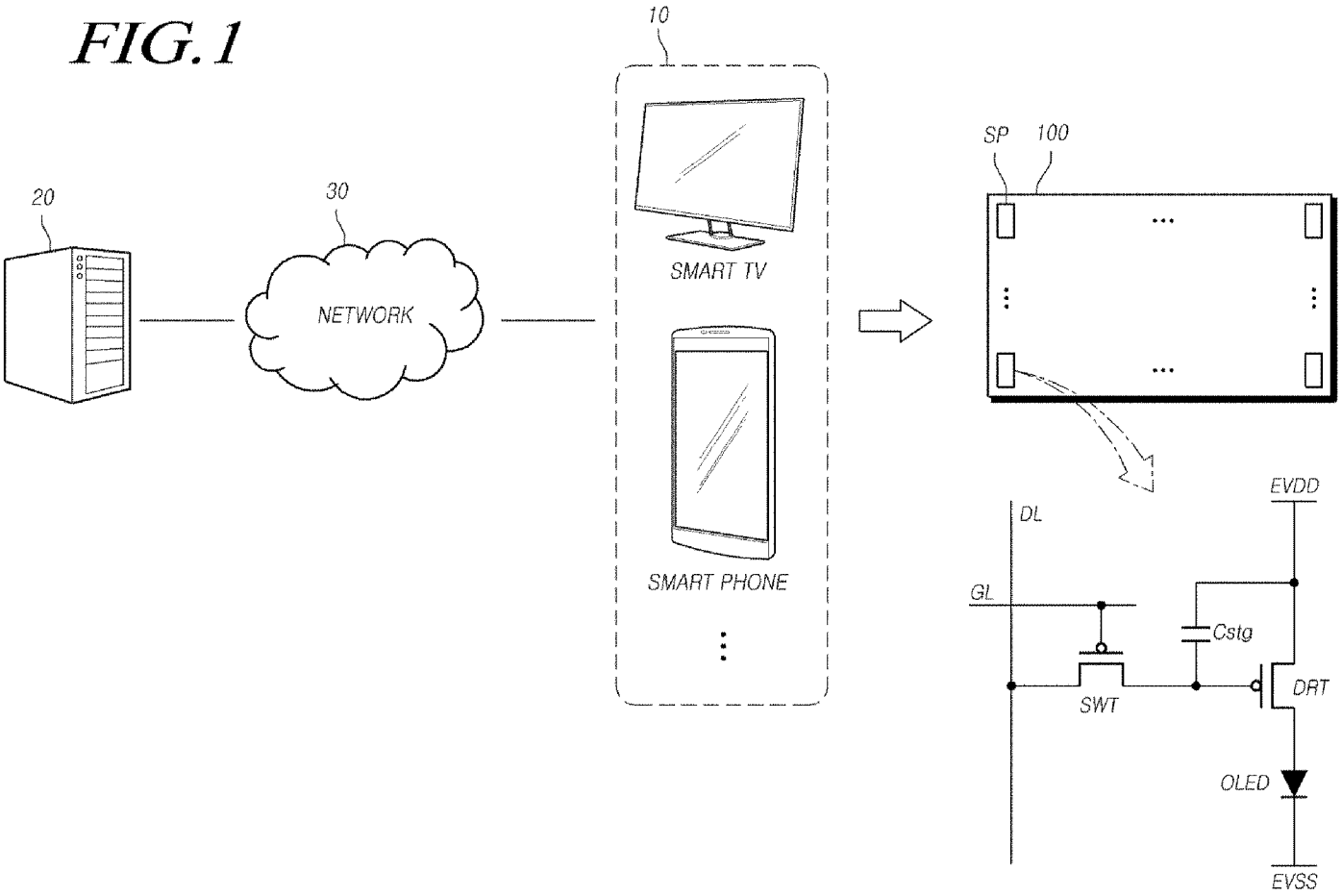
FIG. 1 is a view illustrating a remote compensation service system according to present embodiments.

Reference will now be made in detail to embodiments of the present disclosure, examples of which are illustrated in the accompanying drawings. Throughout this document, reference should be made to the drawings, in which the same reference numerals and signs will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

Figure 2:
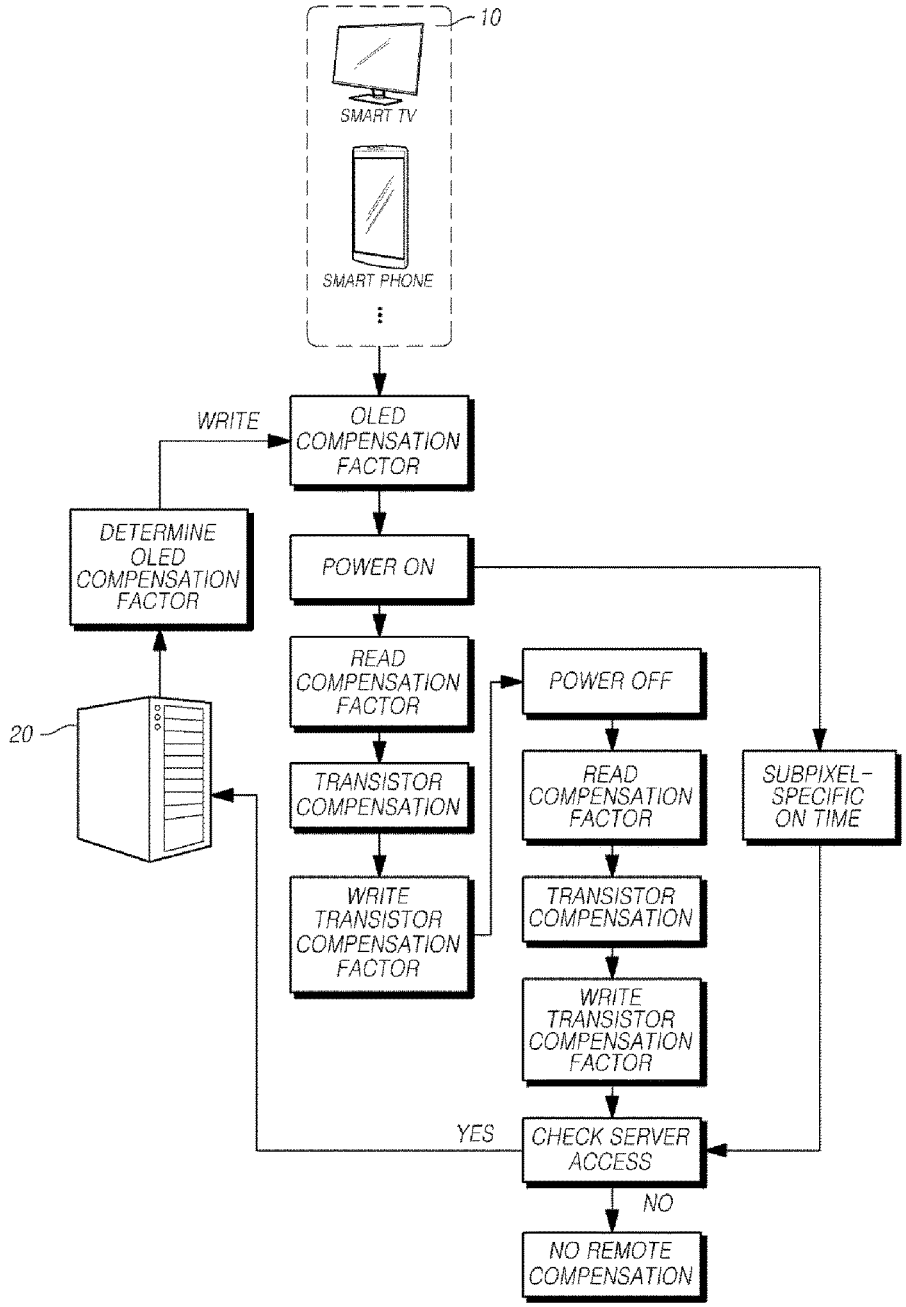
FIG. 2 is a detailed view illustrating a remote compensation service according to the present embodiments.

FIG. 1 is a view illustrating a remote compensation service system according to present embodiments, and FIG. 2 is a detailed view illustrating a remote compensation service according to the present embodiments.

Referring to FIG. 1, a "remote compensation service" according to the present embodiments refers to a service for remotely compensating for characteristics that have changed due to degradations in circuit elements, such as organic light-emitting diodes (OLEDs) and transistors, in an OLED display panel 100 of an OLED display device 10 or for remotely providing compensation-related functions.

The remote compensation service system according to the present embodiments includes a remote compensation server 20 providing the remote compensation service, the OLED display device 10 having the remote compensation service provided by the remote compensation server 20, and the like.

The OLED display device 10 and the remote compensation server 20 are connected via a network 30 to transmit and receive a variety of information and data for the remote compensation service to and from each other.

Referring to FIG. 1, the remote compensation service is carried out as the OLED display device 10 and the remote compensation server 20 communicate with each other by setting a communications connection therebetween through the network 30.

The OLED display device 10 includes the OLED display panel 100 in which an OLED and one or more transistors (DRT and SWT) are disposed on each subpixel.

In one embodiment, the OLED display device 10 does not determine panel compensation information corresponding to OLED compensation factors and transistor compensation factors by calculating or selecting the same by itself in order to compensate for the characteristics of circuit elements, such as the OLED and the transistors, in each subpixel.

Instead, the remote compensation server 20 receives a remote compensation request from the OLED display device 10 and determines panel compensation information, such as OLED compensation factors and transistor compensation factors, about the OLED display device 10 by calculating or selecting the same.

Specifically, in response to the remote compensation request being received from the OLED display device 10, the remote compensation server 20 can determine panel compensation information for the OLED display panel 100 based on a variety of reference information and provide the determined panel compensation information to the OLED display device 10.

The OLED display device 10 can drive the OLED display panel 100 based on the panel compensation information (e.g. OLED compensation factors) provided by the remote compensation server 20.

As described above, in one or more embodiments, the panel compensation information, such as OLED compensation values (OLED compensation factors or information corresponding thereto) and/or transistor compensation values (transistor compensation factors or information corresponding thereto), is not determined by the OLED display device 10 but is determined by the remote compensation server 20 having higher processing performance than the OLED display device 10, so the panel compensation information can be determined more accurately.

Since the remote compensation server 20 determines the panel compensation information on behalf of the OLED display device 10, the OLED display device 10 does not have to have functions or components for obtaining the panel compensation information. Therefore, a complicated control part may not be implemented in the display device 10. Thus, the processing load can be reduced, allowing the cost of the OLED display device 10 to be reduced.

More specifically, by way of example, the OLED display device 10 stores (or writes) OLED compensation factors and/or transistor compensation factors in a memory 360.

Here, OLED compensation factors are also referred to as OLED compensation values, which may mean compensation values related to compensation for degradations in OLEDs.

For example, an OLED compensation factor may be a compensation value related to compensation for the threshold voltage of an OLED.

OLED compensation factors may be information determined by the remote compensation server 20, for example, through calculation or selection.

OLED compensation factors as described above may be used when changing image data to compensate for degradations in the OLED.

Here, transistor compensation factors are also referred to as transistor compensation values, which may mean compensation values related to compensation for degradations in driving transistors in pixels. The driving transistors supply current through the OLED for emitting light.

For example, a transistor compensation factor may be a compensation value related to compensation for degradations in the threshold voltage or a mobility of a driving transistor.

Transistor compensation factors may be information determined by the remote compensation server 20, for example, through calculation or selection.

Transistor compensation factors as described above may be used when changing image data to compensate for degradations in the driving transistor.

Referring to FIG. 2, the OLED display device 10 stores (writes) OLED compensation factors initially provided by the remote compensation server 20 in the memory and updates the OLED compensation factors stored in the memory whenever OLED compensation factors are provided by the remote compensation server 20.

The remote compensation server 20 obtains subpixel-specific on-times (subpixel-specific driving times) of the OLED display panel 100 in order to determine OLED compensation factors.

Thus, as illustrated in FIG. 2, the OLED display device counts and stores subpixel-specific on-times (subpixel-specific driving times) in the memory and transmits the counted subpixel-specific on-times to the remote compensation server 20. The OLED display device 10 obtains different subpixel-specific on-times for each subpixel. For example, if the OLED display device 10 has 32 million RGBW subpixels for displaying a 4K image, then the OLED display device 10 obtains 32 million separate subpixel-specific on-times. The OLED display device 10 measures, for a subpixel, a duration of time (e.g., minutes or a number of frames) during which the subpixel is turned on for a given gray scale level or a range of gray scale levels (e.g., a range between '180'-'230'). In one embodiment, a subpixel is determined to be turned off, when a gray scale level of the subpixel is '0', and is determined to be turned on when the gray scale level of the subpixel is greater than '0'.

Here, the operation of the OLED display device 10 transmitting the subpixel-specific on-times to the remote compensation server 20 corresponds to a remote compensation request through the network 30.

Then, the remote compensation server 20 receives the subpixel-specific on-times from the OLED display device 10 through the network 30, determines OLED compensation factors based on the received subpixel-specific on-times, and then transmits the newly-determined OLED compensation factors to the OLED display device 10.

The OLED display device 10 updates OLED compensation factors stored in the memory by receiving the newly-determined OLED compensation factors from the remote compensation server 20, reads the updated OLED compensation factors, and drives the OLED display panel 100 based on the read OLED compensation factors.

Here, the OLED display device 10 may drive the OLED display panel 100 by changing image data based on OLED compensation factors and then supplying the changed image data to corresponding subpixels.

As described above, the process of compensating for OLEDs, i.e. the process of determining and acquiring OLED compensation factors, is performed by the remote compensation server 20 rather than the OLED display device 10, thereby reducing the processing load of the OLED display device 10.

In addition, since the remote compensation server 20 has a better processing capability than the OLED display device 10, OLED compensation factors can be acquired more accurately.

Furthermore, since the OLED display device 10 is not required to perform the OLED compensation of determining and acquiring OLED compensation factors, the OLED display device 10 does not have to have a module or unit for performing OLED compensation. It is therefore possible to reduce the number of parts or the manufacturing costs of the OLED display device 10.

Referring to FIG. 2, the OLED display device 10 may update and store the subpixel-specific on-times in the memory by counting the same. The subpixel-specific on-times updated and stored in the memory may include gray level-specific on-times for each of the subpixels. For each subpixel, a separate on-time can be determined for each possible gray level. In one example, the OLED display device 10 determines, for a given subpixel, the subpixel has gray level '100' for 10000 frames, and has gray level '255' for 525 frames.

As described above, since the remote compensation server 20 receives the gray level-specific on-times according to the subpixels from the OLED display device 10 and determines OLED compensation factors from the received gray level-specific on-times according to the subpixels (in which calculation process may be included), the remote compensation server 20 can more accurately determine OLED compensation factors. It is therefore possible to more accurately and precisely compensate for degradations in OLEDs, thereby further improving image quality.

Referring to FIG. 2, the OLED display device 10 may perform transistor compensation of sensing characteristics (e.g. threshold voltages and mobility) of transistors in subpixels and determining compensation values related to compensation for the characteristics of transistors in subpixels, and then may store transistor compensation factors (transistor characteristics compensation values), obtained through the transistor compensation, in the memory 360.

As described above, the OLED display device 10 can compensate for transistor characteristics by the transistor compensation, thereby reducing differences in luminance between subpixels due to differences in characteristics between transistors.

The transistor compensation as described above may include at least one of transistor threshold voltage compensation of sensing the threshold voltages of transistors in subpixels and compensating for threshold voltage differences between transistors and transistor mobility compensation of sensing the degrees of mobility of transistors in subpixels and compensating for mobility differences between transistors.

The threshold voltages and the degrees of mobility of transistors sensed and compensated for through the transistor compensation as described above can reduce differences in luminance between subpixels that would otherwise be caused by threshold voltage differences and mobility differences between transistors, thereby improving image quality.

Referring to FIG. 2, the OLED display device 10 can perform the transistor compensation when a power-on signal or a power-off signal is generated.

For example, after the power-on signal is generated, the OLED display device 10 may perform the transistor compensation of sensing the degrees of mobility of transistors and determining mobility compensation values as transistor compensation factors.

When the power-off signal is generated, the OLED display device 10 may perform the transistor compensation of sensing the threshold voltages of transistors, which takes longer time than sensing the degrees of mobility of transistors, and determining threshold voltage compensation values as transistor compensation factors.

As described above, it is possible to efficiently perform the transistor compensation by driving the sensing at points in time suitable to sensing characteristics (the lengths of necessary sensing times) about the threshold voltages and the degrees of mobility of transistors.

The OLED display device 10 may provide sensing data obtained by sensing a voltage or current indicative of the characteristics of transistors (e.g., threshold voltage or mobility of transistors) to the remote compensation server 20 through the network 30. Examples of the sensing data include a value of the voltage or the current indicative of a characteristic of a transistor, a value indicating a threshold voltage or a mobility of a transistor, a value indicating a threshold voltage of an OLED, or any combination thereof. The remote compensation server 20 may determine transistor compensation factors (characteristics compensation values of transistors) based on the provided sensing data and provide the determined transistor compensation factors to the OLED display device 10 through the network 30.

Then, the OLED display device 10 may store the transistor compensation factors received from the remote compensation server 20 and then may change image data based on the transistor compensation factors.

Referring to FIG. 2, the OLED display device 10 checks whether or not communications with the remote compensation server 20 are available, when communications with the remote compensation server 20 are determined to be available, attempts to access the remote compensation server 20, when an access to the remote compensation server 20 has been made, counts accumulated subpixel-specific on-times, and transmits the counted subpixel-specific on-times to the remote compensation server 20.

Afterwards, the OLED display device 10 may receive OLED compensation factors from the remote compensation server 20, the OLED compensation factors determined based on the subpixel-specific on-times by the remote compensation server 20.

As described above, the OLED display device 10 may be provided with a remote compensation service at a suitable time by monitoring the availability of communications with the remote compensation server 20.

In a case in which there are no significant changes in subpixel-specific on-times that have been counted and accumulated, i.e. OLEDs have not been degraded to such a level at which image quality is lowered, when the OLED display device 10 requests the remote compensation server 20 to abundantly transmit subpixel-specific on-times such that subpixel-specific on-times are too frequently updated, OLED compensation factors are unnecessarily updated without an improvement in image quality.

This may consequently increase the amount of data unnecessarily transmitted between the OLED display device 10 and the remote compensation server 20 to increase the processing load of the OLED display device 10 and/or the processing load of the remote compensation server 20.

Thus, the OLED display device 10 may record points in time on which subpixel-specific on-times are transmitted to the remote compensation server 20, and when a predetermined period of time has passed after the recorded points in time, transmit subpixel-specific on-times to the remote compensation server 20.

Then, the remote compensation server 20 is not required to too frequently determine subpixel-specific on-times, and the OLED display device 10 is not required to unnecessarily frequently update OLED compensation factors.

Referring to FIG. 2, the remote compensation server 20 may have OLED degradation lookup tables previously stored therein to determine OLED compensation factors based on the OLED degradation lookup tables and subpixel-specific on-times received from the OLED display device 10.

The OLED degradation lookup tables as stated above may include OLED compensation factors corresponding to on-times. Alternatively, the OLED degradation lookup tables may include degrees of degradations in OLEDs corresponding to on-times.

As described above, the remote compensation server 20 may easily and conveniently determine OLED compensation factors using the degradation lookup tables.

The OLED degradation lookup tables may be generated through OLED lifetime assessment performed on a plurality of OLED display panels and may be stored and managed in the remote compensation server 20 during the fabrication process or the period in which the remote compensation service is being provided.

Here, the OLED lifetime assessment includes causing degradations in an OLED by driving the OLED and then measuring the luminance levels of the OLED depending on driving times (on-times).

The OLED lifetime assessment is performed using an OLED lifetime assessment system, and through the assessment, the luminance levels of OLEDs are measured.

Then, the OLED lifetime assessment system or the remote compensation server 20 may determine compensation values (OLED compensation factors), based on which measured luminance levels are compensated for, and may create the OLED degradation lookup tables including the OLED compensation factors determined according to driving times (on-times).

The OLED degradation lookup tables may be generated according to the types of OLED display panels 100 or the types of OLED display devices 10. Example types of OLED display panels 100 include a panel size, a pixel pattern (e.g., RGB, RWGB, etc.), a sub-pixel structure (e.g., 3T1C, 4T1C, 4T2C, 5T1C, 6T1C, etc.).

Thus, the remote compensation server 20 may have OLED degradation lookup tables according to the types of OLED display panels 100 or the types of OLED display devices 10 stored therein and may provide a categorized, customized remote compensation service using an OLED degradation lookup table matching an OLED display device 10 that has requested for remote compensation.

Considering these matters, the OLED display device 10 may transmit product identification information or panel identification information, in addition to subpixel-specific on-times, to the remote compensation server 20.

Responsively, the remote compensation server 20 may automatically generate an OLED degradation lookup table corresponding to product identification information or panel identification information, received together with subpixel-specific on-times from the OLED display device 10, according to products or OLED display panels, and may automatically determine OLED compensation factors based on the generated OLED degradation lookup table and the subpixel-specific on-times received from the OLED display device 10.

As described above, the OLED display device 10 may obtain OLED compensation factors suitable to the OLED display panel 100 disposed therein.

The OLED display device 10 for providing a remote compensation service according to the present embodiments may be implemented as a monitor, a middle-sized or larger display device, such as a smart television (TV), or a mobile device, such as a smartphone, a tablet personal computer (PC), a personal digital assistant (PDA), or a mobile communications terminal.

The OLED display device 10 is not limited thereto and may be implemented as any device that can communicate with the remote compensation server 20 while including the OLED display panel 100.

The remote compensation server 20 for providing a remote compensation service according to the present embodiments has a set of hardware configured the same as a web server, a web application server, or a wireless application protocol (WAP) server. However, in terms of software, the remote compensation server 20 may include a program module embodied based on a language, such as C, C++, Java, PHP, .Net, Python, or Ruby, to perform several functions.

The remote compensation server 20 may be connected to a plurality of OLED display devices 10 acting as clients via the network 30. In this case, the remote compensation server 20 may be a computer system that receives a task execution request from a client or another server, obtains a result by performing the task, and provides the result to the client or another server or may be a set of computer software (a server program) installed for this computer system.

The remote compensation server 20 may include a series of application programs running on the remote compensation server 20, or in some cases, a variety of databases constructed inside or outside of the remote compensation server 20, in addition to the server program.

The network 30 connecting the OLED display device 10 and the remote compensation server 20 may be an open network, such as the Internet, or a closed network, such as a local area network (LAN) or a wide area network (WAN).

In addition, when the OLED display device 10 is a mobile device, such as a smartphone, a tablet PC, a PDA, or a mobile communications terminal, the network 30 may further include a wireless access network, such as a mobile communications network or a WiFi network.

Reference will now be made in detail to the OLED display device 10 and the remote compensation server 20 included in the remote compensation server system according to the present embodiments as described above.

Figure 3:
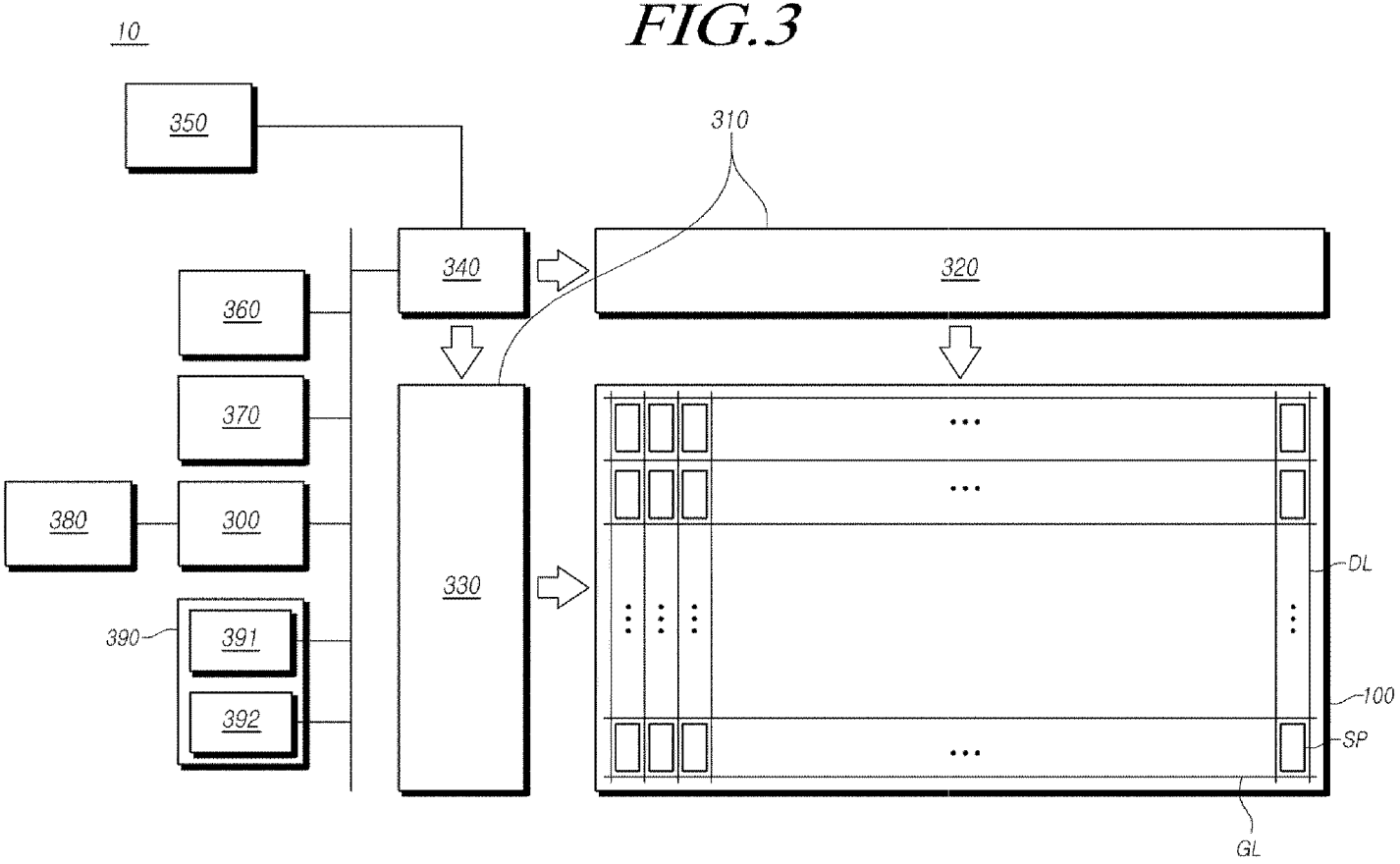
FIG. 3 is a configuration view illustrating an OLED display device according to the present embodiments.

FIG. 3 is a configuration view illustrating the OLED display device 10 according to the present embodiments.

Referring to FIG. 3, the OLED display device 10 for a remote compensation service according to the present embodiments includes the OLED display panel 100, a driver 310, a controller 340, a host module 350, a remote processor 300, a memory 360, a counter 370, a communications module 380, a compensator 390, and the like. These components (e.g., modules or other components shown in FIG. 3) may be implemented as hardware, software, or a combination of both.

In the OLED display panel 100, an OLED and one or more transistors are disposed in each of subpixels SP.

The driver 310 may drive the OLED display panel 100.

The communications module 380 may communicate with the remote compensation server 20 through the network 30.

The communications module 380 may be a wired communications module or a wireless communications module.

The memory 360 stores OLED compensation factors, subpixel-specific on-times, and the like.

The memory 360 may be a single memory or may be two or more memories divided according to the types of information or data stored therein.

The counter 370 may count and update subpixel-specific on-times stored in the memory 360. The counter 370 may be implemented as a circuit block. In one example, the counter 370 counts that a subpixel is on with a gray level '100'-'150' for 10000 frames, with a gray level '151'-'200' for 525 frames, etc. Analyzing subpixel-specific on-times for different gray scale levels for a pixel allows determination of accurate compensation factors.

The remote processor 300 is a control component for a remote compensation service. In one embodiment, the remote processor 300 can be implemented on a reconfigurable hardware (e.g., a field programmable gate array (FPGA)), or one or more application specific integrated circuits (ASICs). The remote processor 300 may transmit subpixel-specific on-times stored in the memory 360 to the remote compensation server 20 via the communications module 380, receive OLED compensation factors newly-determined by the remote compensation server 20, and update OLED compensation factors stored in the memory 360.

The compensator 390 may include an OLED compensator 391 and a transistor compensator 392.

The OLED compensator 391 may change image data based on updated OLED compensation factors.

Here, the OLED compensator 391 of the OLED display device 10 acquires OLED compensation factors for OLED compensation by receiving the OLED compensation factors from remote compensation server 20 instead of determining the OLED compensation factors by itself.

The OLED compensator 391 of the OLED display device 10 performs the processing of changing image data using OLED compensation factors acquired from the remote compensation server 20, such that degradations in OLEDs are substantially compensated for.

The OLED display device 10 as described above does not determine OLED compensation factors by itself in order to compensate for degradations in OLEDs (occurring as changes in threshold voltages) in the OLED display panel 100, but instead receives OLED compensation factors determined by the remote compensation server 20 and applies the received OLED compensation factors to compensate for degradations in OLEDs (e.g. changes image data). It is therefore possible to significantly reduce the processing load due to the calculation of OLED compensation factors or the like while more accurately perform compensation for degradations in OLEDs.

The transistor compensator 392 may perform the transistor compensation (i.e. may determine transistor compensation factors corresponding to the characteristics compensation values of transistors related to compensation for the characteristics of transistors based on sensing data obtained by sensing the characteristics of transistors).

The transistor compensator 392 may store transistor compensation factors, obtained through the transistor compensation, in the memory 360.

The transistor compensator 392 of the OLED display device 10 as described above may compensate for characteristics of transistors (e.g. a driving transistor DRT illustrated in FIG. 7), i.e. may reduce differences in characteristics between transistors (e.g. differences in threshold voltages or mobility). This may consequently reduce differences in luminance between subpixels due to the differences in characteristics between transistors, thereby improving image quality.

The transistor compensation of determining transistor compensation factors corresponding to compensation values of transistors related to compensation for the characteristics of transistors based on sensing data obtained by sensing the characteristics of transistors may also be performed by the remote compensation server 20.

In this case, the transistor compensator 392 may receive the transistor compensation factors obtained through the transistor compensation performed by the remote compensation server 20 and store the transistor compensation factors in the memory 360.

The remote processor 300 may check whether or not communications with the remote compensation server 20 via the communications module 380 are available. When communications with the remote compensation server 20 are determined to be available, the remote processor 300 may transmit subpixel-specific on-times to the remote compensation server 20.

In a case in which there are no significant changes in subpixel-specific on-times that have been counted and accumulated, i.e. OLEDs have not been degraded to such a level at which image quality is lowered, when the OLED display device 10 requests the remote compensation server 20 to abundantly transmit subpixel-specific on-times such that the subpixel-specific on-times are too frequently updated, OLED compensation factors are unnecessarily updated without an improvement in image quality.

This may consequently increase the amount of data unnecessarily transmitted between the OLED display device 10 and the remote compensation server 20 to increase the processing load of the OLED display device 10 and/or the processing load of the remote compensation server 20.

Thus, the OLED display device 10 may record points in time on which the subpixel-specific on-times are transmitted to the remote compensation server 20 and transmit subpixel-specific on-times, which have been counted and accumulated up to present, to the remote compensation server 20 after a predetermined period of time has passed after the recorded points in time.

As described above, the remote compensation server 20 can avoid unnecessarily determining subpixel-specific on-times, and the OLED display device 10 can avoid unnecessarily updating OLED compensation factors.

The predetermined period of time is a period of time defining a period of remote compensation, and may be set as a period of time in which OLEDs may degrade to such a level at which image quality is influenced.

The predetermined period of time may be set to a fixed value or may be adaptively varied by the OLED display device 10 or the remote compensation server 20.

Referring to FIG. 3, at least one of the counter 370, the remote processor 300, and the compensator 390 may be embodied within the controller 340 or may be embodied as separate parts outside of the controller 340.

The driver 310 may include a data driver 320 driving a plurality of data lines DL disposed on the OLED display panel 100 and a gate driver 330 driving a plurality of gate lines GL disposed on the OLED display panel 100.

Referring to FIG. 3, in the OLED display device 10 according to the present embodiments, a plurality of sub-pixels SP as well as the plurality of data lines DL and the plurality of gate lines GL may be disposed on the OLED display panel 100.

In the OLED display device 10 according to the present embodiments, the controller 340 may control the data driver 320 and the gate driver 330.

The controller 340 controls the data driver 320 and the gate driver 330 by supplying a variety of control signals to the data driver 320 and the gate driver 330.

The controller 340 starts scanning in points in time realized by frames, converts image data input by the host module 350 into a data signal format used in the data driver 320, outputs the converted image data, and in response to the scanning, regulates data driving at suitable points in time.

The controller 340 may be a timing controller used in a typical display device or may be a controller including a timing controller and performing other control functions.

The data driver 320 drives the plurality of data lines DL by supplying data voltages thereto. The data driver 320 is also referred to as a "source driver."

The gate driver 330 drives the plurality of gate lines GL by sequentially sending scanning signals thereto. The gate driver 330 is also referred to as a "scanning driver."

The gate driver 330 sequentially supplies scanning signals having an on or off voltage to the plurality of gate lines GL under the control of the controller 340.

When a specific gate line is opened by the gate driver 330, the data driver 320 converts image data received from the controller 340 into analog data voltages and supplies the analog data voltages to the plurality of data lines DL.

Although the data driver 320 is illustrated in FIG. 3 as being positioned on one side (the upper side or the lower side) of the OLED display panel 100, the data driver 320 may be positioned on both sides (e.g. both the upper side and the lower side) of the OLED display panel 100 depending on the driving method, the design of the panel, or the like.

Although the gate driver 330 is illustrated in FIG. 3 as being positioned on one side (the left side or the right side) of the OLED display panel 100, the gate driver 330 may be positioned on both sides (e.g. both the left side and the right side) of the OLED display panel 100 depending on the driving method, the design of the panel, or the like.

The controller 340 receives a variety of timing signals including a vertical synchronization signal Vsync, a horizontal synchronization signal Hsync, an input data enable (DE) signal, and a clock signal from the host module 350, together with input image data.

The controller 340 not only outputs converted image data by converting image data input from an external source into a data signal format readable by the data driver 320, but also outputs a variety of control signals to the data driver 320 and the gate driver 330 by generating the variety of control signals in response to a variety of received timing signals, including a vertical synchronization signal Vsync, a horizontal synchronization signal Hsync, an input DE signal, and a clock signal, in order to control the data driver 320 and the gate driver 330.

For example, the controller 340 outputs a variety of gate control signals (GCSs) including a gate start pulse (GSP), a gate shift clock (GSC) signal, and a gate output enable (GOE) signal in order to control the gate driver 330.

Here, the GSP controls the operation start timing of one or more gate driver ICs (GDICs) of the gate driver 330. The GSC signal is a clock signal commonly input to the GDICs to control the shift timing of scanning signals (gate pulses). The GOE signal designates the timing information of one or more GDICs.

In addition, the controller 340 outputs a variety of data control signals (DCSs) including a source start pulse (SSP), a source sampling clock (SSC) signal, and a source output enable (SOE) signal in order to control the data driver 320.

Here, the SSP controls the data sampling start timing of one or more source driver ICs (SDICs) of the data driver 320. The SSC signal is a clock signal controlling the data sampling timing of each of the SDICs. The SOE signal controls the output timing of the data driver 320.

The data driver 320 may include one or more SDICs configured to drive corresponding data lines.

Each of the SDICs may be connected to the bonding pads of the OLED display panel 100 by tape-automated bonding (TAB) or chip-on-glass (COG) bonding, may be directly disposed on the OLED display panel 100, or in some cases, may be integrated with the OLED display panel 100, on a portion of the OLED display panel 100. Alternatively, each of the SDICs may be mounted on a film connected to the OLED display panel 100 by a chip-on film (COF) method.

Each of the source driver ICs may include a shift register, a latch circuit, a digital-to-analog converter (DAC), an output buffer, and the like.

In some cases, each of the source driver ICs may further include an analog-to-digital converter (ADC).

The gate driver 330 may include one or more GDICs.

Each of the GDICs may be connected to the bonding pads of the OLED display panel 100 by tape-automated bonding (TAB) or chip-on-glass (COG) bonding, may be implemented as a gate-in-panel (GIP)-type IC directly disposed on the OLED display panel 100, or in some cases, may be integrated with the OLED display panel 100, on a portion of the OLED display panel 100. Alternatively, each of the GDICs may be mounted on a film connected to the OLED display panel 100 by a chip-on film (COF) method.

Each of the GDICs may include a shift register, a level shifter, and the like.

The OLED display device 10 according to the present embodiments may include one or more source printed circuit boards (S-PCBs) for circuit-connection to one or more SDICs and a control printed circuit board (C-PCB) on which control components and a variety of electronic devices are mounted.

Each of the S-PCBs may have a SDIC mounted thereon, or may be connected to a film on which the SDIC is mounted.

The C-PCB may have the controller 340, a power controller, and the like mounted thereon, in which the controller 340 controls the operations of the data driver 320, the gate driver 330, and the like, and the power controller supplies a variety of voltages or currents to or controls the supply of the variety of voltages or currents to the OLED display panel 100, the data driver 320, the gate driver 330, and the like.

Each of the S-PCBs and the C-PCB may be connected by means of one or more connecting members.

Here, the connecting member may be a flexible printed circuit (FPC), a flexible flat cable (FFC), or the like.

Each of the S-PCBs and the C-PCB may be integrated as a single PCB.

The other components except for the host module 350 and the communications module 380 in FIG. 3 may form a display module.

In addition, each of the subpixels SP disposed on the OLED display panel 100 may include a circuit element, such as a transistor.

For example, each subpixel SP includes circuit elements, such as an OLED and a driving transistor for driving the OLED.

The types and number of circuit elements of each subpixel SP may be determined variously depending on functions provided thereby, the design thereof, and the like.

Figure 4:
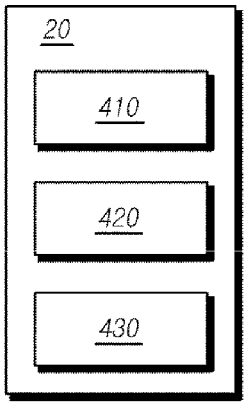
FIG. 4 is a block diagram illustrating a remote compensation server according to the present embodiments.

FIG. 4 is a block diagram illustrating the remote compensation server 20 according to the present embodiments.

Referring to FIG. 4, the remote compensation server 20 for a remote compensation service according to the present embodiments may include a communications module 410, a remote compensator module 420, and a memory 430.

The communications module 410 communicates with the OLED display device 10 that has accessed the remote compensation server 20 via a wired or wireless medium.

The remote compensator module 420 may determine (or update) OLED compensation factors based on subpixel-specific on-times transmitted by the OLED display device 10 and received via the communications module 410, and transmit the determined (or updated) OLED compensation factors to the OLED display device 10 via the communications module 410.

The remote compensator module 420 determines and provides the OLED compensation factors to the OLED display device 10, such that the remote compensation server 20 provides a remote compensation service.

When the remote compensation server 20 as described above is used, the OLED display device 10 as described above does not determine OLED compensation factors by itself in order to compensate for degradations in OLEDs (occurring as changes in threshold voltages) in the OLED display panel 100, but receives OLED compensation factors determined by the remote compensation server 20 and applies the received OLED compensation factors to compensation for degradations in OLEDs (e.g. changes image data). It is therefore possible to significantly reduce the processing load due to the calculation of OLED compensation factors or the like while more accurately perform compensation for degradations in OLEDs.

Referring to FIG. 4, the memory 430 may have OLED degradation lookup tables previously stored therein.

The remote compensator module 420 may determine OLED compensation factors based on the OLED degradation lookup tables and subpixel-specific on-times received from the OLED display device 10.

As described above, the remote compensation server 20 may easily and conveniently determine OLED compensation factors using the degradation lookup tables.

The OLED degradation lookup tables may be generated through OLED lifetime assessment performed on a plurality of OLED display panels and may be stored and managed in the remote compensation server 20 during the fabrication process or the period in which the remote compensation service is being provided.

Here, the OLED lifetime assessment includes causing degradations in an OLED by driving the OLED and then measuring the luminance levels of the OLED depending on driving times (on-times).

The OLED lifetime assessment is performed using an OLED lifetime assessment system, and through the assessment, the luminance levels of OLEDs are measured.

Then, the OLED lifetime assessment system or the remote compensation server 20 may determine compensation values (OLED compensation factors), based on which measured luminance levels are compensated for, and may generate the OLED degradation lookup tables including the OLED compensation factors determined according to driving times (on-times).

The OLED degradation lookup tables may be generated according to the types of OLED display panels 100 or the types of OLED display devices 10.

Thus, the remote compensation server 20 may have OLED degradation lookup tables according to the types of OLED display panels 100 or the types of OLED display devices 10 stored therein and may provide a categorized, customized remote compensation service using an OLED degradation lookup table matching an OLED display device 10 that has requested for remote compensation.

The remote compensation service method according to the present embodiments as described above will be briefly described again.

Figure 5:
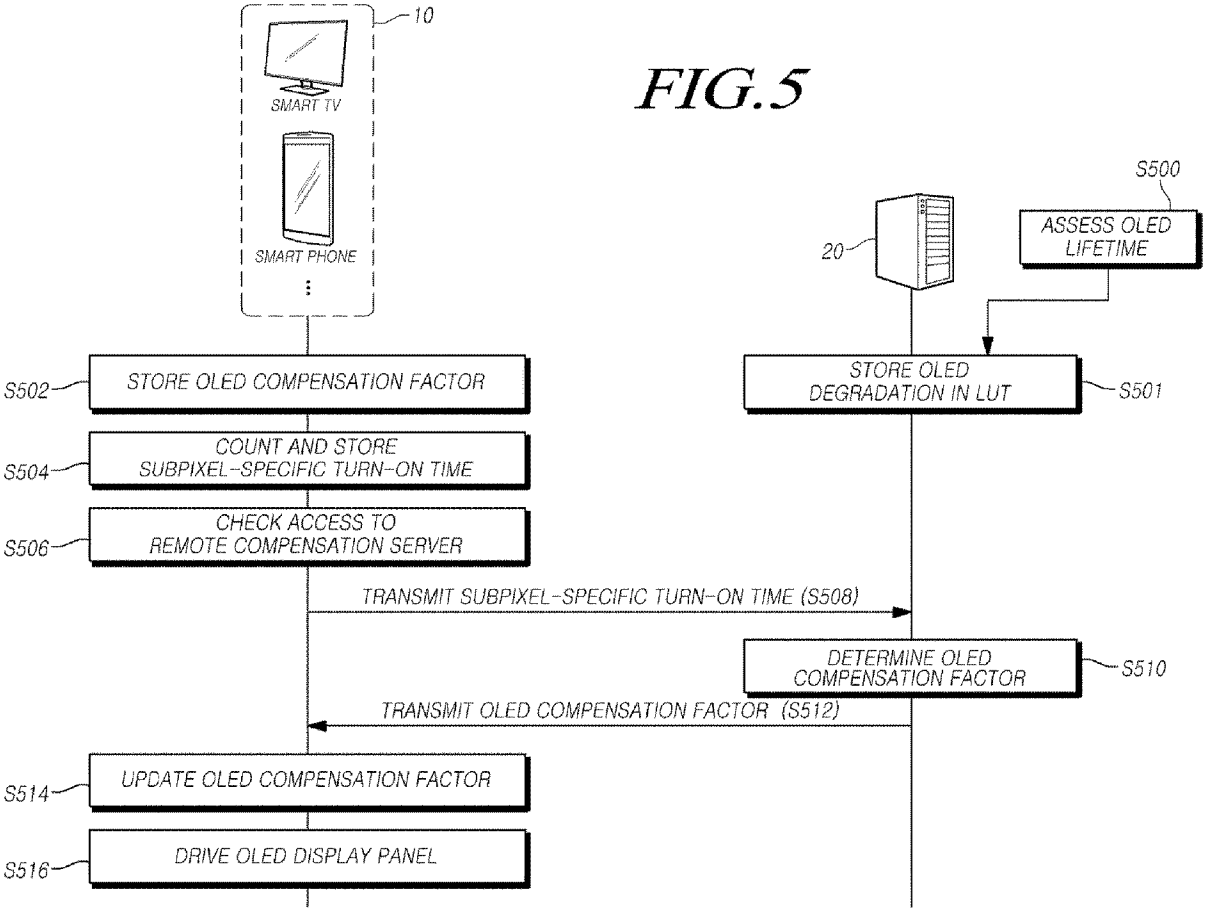
FIG. 5 is a flow diagram illustrating a remote compensation service method according to the present embodiments.

FIG. 5 is a flow diagram illustrating the remote compensation service method according to the present embodiments.

Referring to FIG. 5, the remote compensation service method according to the present embodiments may include: operation S504 of counting, by the OLED display device 10, subpixel-specific on-times; operation S506 of checking, by the OLED display device 10, whether or not a communication access to the remote compensation server 20 has been made; operation S508 of transmitting, by the OLED display device 10, the counted subpixel-specific on-times to the remote compensation server 20; operation S510 of newly determining, by the remote compensation server 20, OLED compensation factors based on the received subpixel-specific on-times; operation S512 of transmitting, by the remote compensation server 20, the newly-determined compensation factors to the OLED display device 10; operation S514 of updating, by the OLED display device 10, OLED compensation factors stored in the memory 360 by receiving the newly-determined OLED compensation factors transmitted from the remote compensation server 20; and operation S516 of driving, by the OLED display device 10, the OLED display panel 100 based on the updated OLED compensation factors.

When the remote compensation service method as described above is used, panel compensation information, such as OLED compensation values (OLED compensation factors or information corresponding thereto) and/or transistor compensation values (transistor compensation factors or information corresponding thereto), is not determined by the OLED display device 10 but is determined by the remote compensation server 20 having higher processing performance than the OLED display device 10, so the panel compensation information can be determined more accurately.

Since the remote compensation server 20 determines the panel compensation information on behalf of the OLED display device 10, the OLED display device 10 does not have to have functions or components required for obtaining the panel compensation information. It is therefore unnecessary to design a complicated control part and it is possible to reduce the processing load, thereby reducing the price of the OLED display device 10.

Before the above-described operation S504, in operation S502, the OLED display device 10 may have the OLED compensation factors previously stored therein, provided by the remote compensation server 20.

In addition, the remote compensation server 20 may have an OLED lookup table previously stored therein (S501) through OLED lifetime assessment (S500).

In this case, the remote compensation server 20 may determine OLED compensation factors based on the previously-stored OLED degradation lookup tables and subpixel-specific on-times received from the OLED display device 10.

Reference will now be made in greater detail to transistor compensation of compensating for the characteristics (e.g. threshold voltages and the degrees of mobility) of transistors based on the structure of subpixels in which degradation in OLEDs occur and sensing data obtained by sensing the characteristics of transistors.

Figure 6:
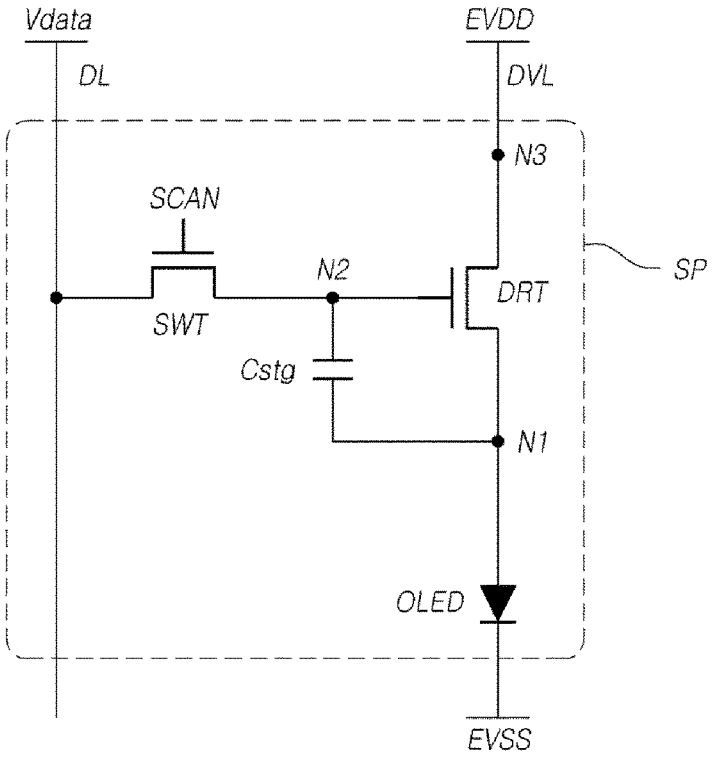
FIG. 6 is a circuit diagram illustrating an exemplary subpixel structure of the OLED display device according to the present embodiments.

FIG. 6 is a circuit diagram illustrating an exemplary subpixel structure of the OLED display device 10 according to the present embodiments.

Referring to FIG. 6, in the OLED display device 10 according to the present embodiments, each subpixel includes an OLED, a driving transistor DRT driving the OLED, a switching transistor SWT transferring a data voltage to a second node N2 corresponding to the gate node of the driving transistor DRT, and a storage capacitor Cstg maintaining the data voltage corresponding to an image signal voltage or a voltage corresponding to the data voltage for a period of a single frame.

The OLED may include a first electrode (e.g. an anode), an organic layer, a second electrode (e.g. a cathode), and the like.

The first electrode may be connected to a first node N1 of the driving transistor DRT, and the second electrode may be connected to a supply point of a base voltage EVSS.

The driving transistor DRT drives the OLED by supplying current to the OLED, according to a voltage across the storage capacitor Cstg.

The first node N1 of the driving transistor DRT may be electrically connected to the first electrode of the OLED, and may act as a source node or a drain node. The second node N2 of the driving transistor DRT may be electrically connected to a source node or a drain of the switching transistor SWT, and may act as a gate node. A third node N3 of the driving transistor DRT may be electrically connected to a driving voltage line DVL, through which the base voltage EVDD is supplied, and may act as the drain node or the source node.

As illustrated in FIG. 2, the driving transistor DRT and the switching transistor SWT may be n-type transistors or p-type transistors.

The switching transistor SWT may be electrically connected between a data line DL and the second node of the driving transistor DRT, and may be controlled in response to a scanning signal SCAN applied to the gate node thereof through a gate line.

The switching transistor SWT may be turned on by the scanning signal to transfer a data voltage Vdata supplied from the data line DL to the second node N2 of the driving transistor DRT.

The storage capacitor Cstg may be electrically connected between the first node N1 and the second node N2 of the driving transistor DRT.

The storage capacitor Cstg is not a parasitic capacitor (e.g. Cgs or Cgd), i.e. an internal capacitor formed between the first node N1 and the second node N2 as part of the driving transistor DRT, but is a distinct component from the driving transistor DRT.

In the case of OLED display device 10 according to the present embodiments, circuit elements, such as an OLED and a transistor DRT, may undergo degradations in quality along with the lapse of the driving time of each subpixel SP.

This may consequently change unique characteristics (e.g. threshold voltages and mobility) of the circuit elements, such as the OLED and the transistor DRT.

Such changes in the characteristics of the circuit elements lead to changes in the luminance of the corresponding subpixel. Thus, changes in the characteristics of the circuit elements may correspond to changes in the luminance of the subpixel.

In addition, the degrees of changes in the characteristics between circuit elements may differ depending on the degrees of degradations in the circuit elements.

Such differences in characteristics between circuit elements cause differences in luminance between subpixels. Thus, differences in characteristics between circuit elements may correspond to differences in luminance between subpixels.

Changes in the luminance of subpixels or differences in luminance between subpixels as described above may lower the accuracy of the ability of subpixels to express luminance or may cause the screen to malfunction, which is problematic.

Here, the characteristics of circuit elements (hereinafter, also referred to as the "subpixel characteristics") may include, for example, the threshold voltages and the degrees of mobility of driving transistors DRT, and/or the threshold voltages of OLEDs.

The OLED display device 10 according to the present embodiments may provide a function of sensing (measuring) changes in the luminance of subpixels and differences in luminance between subpixels (changes in the characteristics of circuit elements and differences in characteristics between circuit elements) and a function of compensating for changes in the luminance of subpixels and differences in luminance between subpixels based on the result of the sensing.

In order to provide the functions of sensing and compensating for changes in the luminance of subpixels and differences in luminance between subpixels, the OLED display device 10 according to the present embodiments includes a relevant subpixel structure and a compensation circuit including sensing and compensation components.

Figure 7:
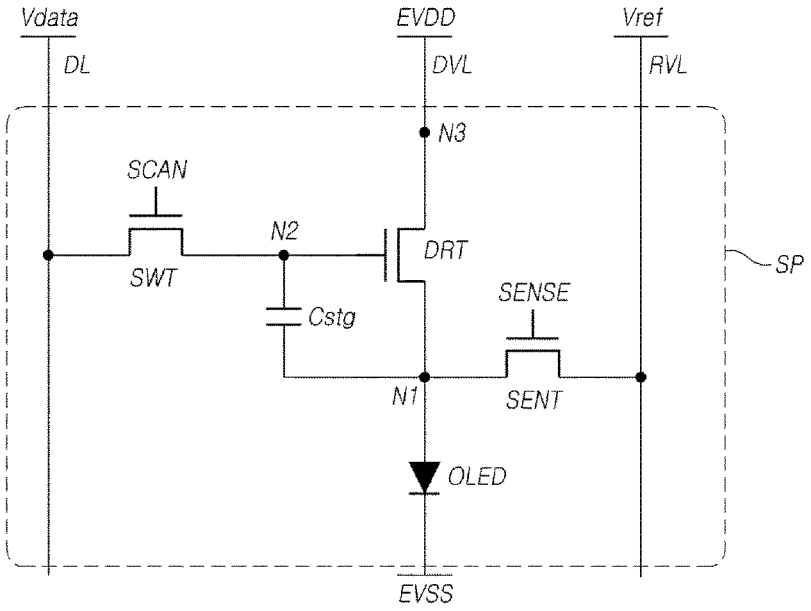
FIG. 7 is a circuit diagram illustrating another exemplary subpixel structure of the OLED display device according to the present embodiments.

FIG. 7 is a circuit diagram illustrating another exemplary subpixel structure of the OLED display device according to the present embodiments.

Referring to FIG. 7, each of subpixels disposed on the OLED display panel 100 according to the present embodiments includes, for example, an OLED, a driving transistor DRT, a switching transistor SWT, and a storage capacitor Cstg, as well as a sensing transistor SENT.

The sensing transistor SENT may be electrically connected between a first node N1 of the driving transistor DRT and a reference voltage line RVL, through which a reference voltage Vref is supplied, and may be controlled in response to a sensing signal SENSE, a type of scanning signal, being applied to a gate node thereof.

The sensing transistor SENT is turned on in response to the sensing signal SENSE, and applies the reference voltage Vref supplied through the reference voltage line RVL to the first node N1 of the driving transistor DRT.

In addition, the sensing transistor SENT may be used as one of voltage-sensing paths for the first node N1 of the driving transistor DRT.

A scanning signal SCAN and the sensing signal SENSE may be separate gate signals. In this case, the scanning signal SCAN and the sensing signal SENSE may be applied to a gate node of the switching transistor SWT and a gate node of the sensing transistor SENT, respectively, through different gate lines.

In some cases, the scanning signal SCAN and the sensing signal SENSE may be the same gate signal. In this case, the scanning signal SCAN and the sensing signal SENSE may be applied in common to the gate node of the switching transistor SWT and the gate node of the sensing transistor SENT through the same gate line.

Figure 8:
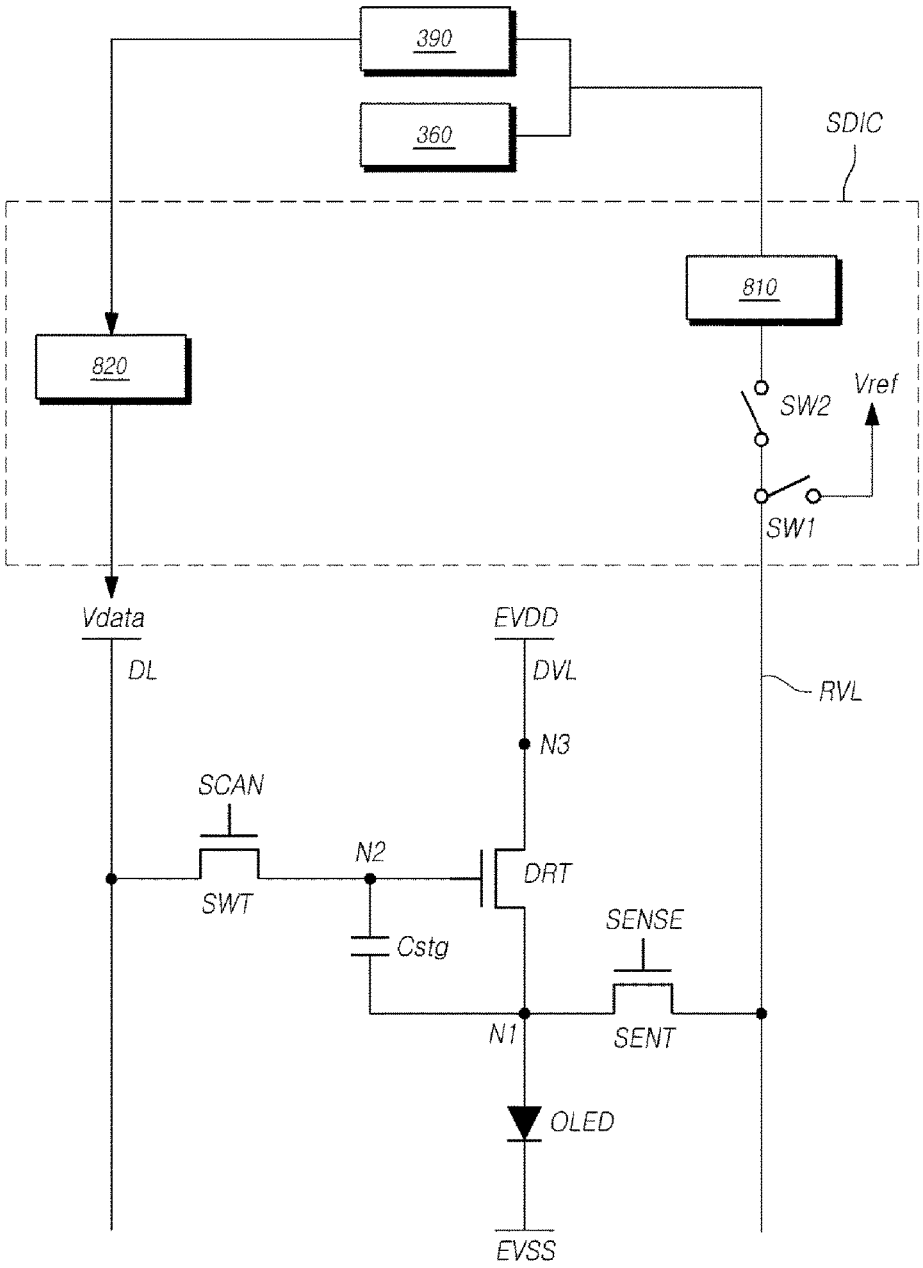
FIG. 8 is a diagram illustrating an exemplary compensation circuit of the OLED display device according to the present embodiments.

FIG. 8 is a diagram illustrating an exemplary compensation circuit of the OLED display device 10 according to the present embodiments.

Referring to FIG. 8, the OLED display device 10 according to the present embodiments includes a sensor 810, the memory 360, and the compensator 390. The sensor 810 is configured to sense changes in the characteristics of subpixels (characteristics of driving transistors and characteristics of OLEDs) and/or differences in characteristics between subpixels and to output sensing data. The memory 360 stores the sensing data therein. In one embodiment, the sensing data stored in the memory 360 can be forwarded to the remote compensation server 20 through the network 30. In one embodiment, the remote compensation server 20 obtains the compensation factors (e.g., OLED compensation factors and/or transistor compensation factors) based on the sensing data, and provides the obtained compensation factors to the OLED display device 10 through the network 30. In another embodiment, the compensator 390 obtains the compensation factors based on the sensing data. The compensation factors can be stored at the memory 360. The compensator 390 performs a compensation process to compensate for changes in the characteristics of subpixels and/or differences in characteristics between subpixels, based on the compensation factors stored at the memory 360.

The sensor 810 may include one or more analog-to-digital converters (ADCs).

Each of the ADCs may be included inside an SDIC, and in some cases, may be disposed outside of the SDIC.

The compensator 390 may be included inside the controller 340, or may be disposed outside of the controller 340.

Sensing data output from the sensor 810 may be composed of, for example, a low-voltage differential signaling (LVDS) data format.

The OLED display device 10 according to the present embodiments may further include a first switch SW1 and a second switch SW2 in order to control the sensing driving, i.e. in order to control the voltage application state of the first node N1 of the driving transistor DRT in each subpixel SP in a state related to sensing of subpixel characteristics.

Whether or not to supply the reference voltage Vref to the reference voltage line RVL may be controlled using the first switch SW1.

When the first switch SW1 is turned on, the reference voltage Vref may be applied to the first node N1 of the driving transistor DRT through the turned-on sensing transistor SENT.

When the voltage state of the first node N1 of the driving transistor DRT reflects subpixel characteristics, the voltage state of the reference voltage line RVL may reflect subpixel characteristics, in which the reference voltage line RVL may be equipotential with the first node N1 of the driving transistor DRT. Here, a line capacitor formed on the reference voltage line RVL may be charged with a voltage that reflects subpixel characteristics.

When the voltage state of the first node N1 of the driving transistor DRT reflects subpixel characteristics, the second switch SW2 is turned on, such that the sensor 810 is connected to the reference voltage line RVL.

Then, the sensor 810 senses the voltage of the reference voltage line RVL, the state of which reflects subpixel characteristics, i.e. the voltage of the first node N1 of the driving transistor DRT. Here, the reference voltage line RVL is also referred to as a "sensing line."

A single reference voltage line RVL as described above may be present in every subpixel row (or column) or may be present in at least every second subpixel row (or column).

For example, when a pixel is composed of four subpixels (red, white, green, and blue subpixels), a single reference voltage line RVL may be present in every pixel row or column including four subpixel rows or columns (red, white, green, and blue subpixel rows or columns).

When the sensor 810 is connected to the reference voltage line RVL, the sensor 810 senses the voltage of the first node N1 of the driving transistor DRT (the voltage of the reference voltage line RVL or a voltage charged in the line capacitor on the reference voltage line RVL).

The voltage sensed by the sensor 810 may be a voltage value Vdata-Vth or Vdata-ΔVth including a threshold voltage Vth or a threshold voltage difference ΔVth of the driving transistor DRT or may be a voltage value related to sensing of the mobility of the driving transistor DRT.

Reference will now be briefly made to a threshold voltage sensing driving operation and a mobility sensing driving operation for the driving transistor DRT.

Figure 9A:
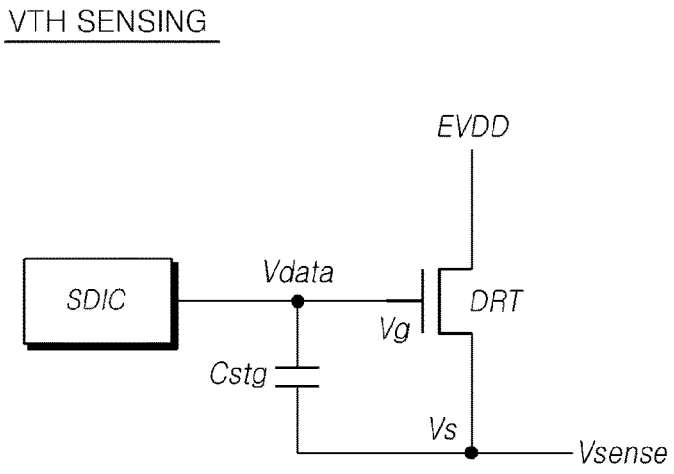
FIG. 9A and FIG. 9B are a circuit diagram and a graph illustrating a threshold voltage sensing driving method for a driving transistor in the OLED display device according to the present embodiments.
Figure 9B:
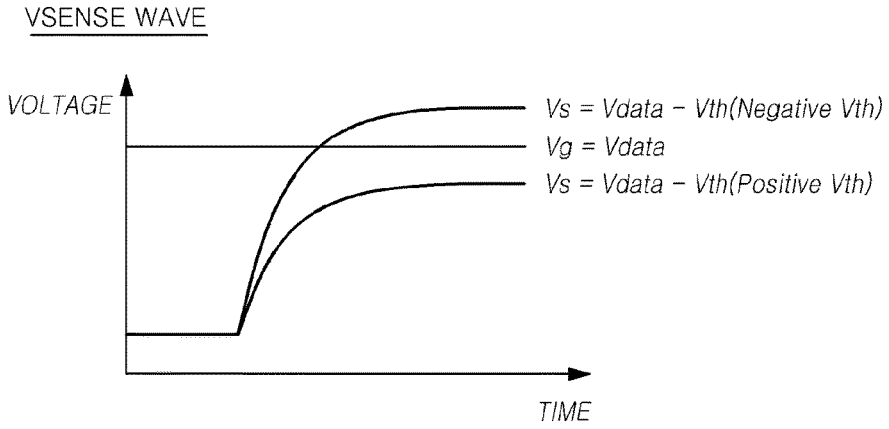

FIG. 9A and FIG. 9B are a circuit diagram and a voltage graph illustrating a threshold voltage sensing driving method for the driving transistor DRT in the OLED display device 10 according to the present embodiments.

Referring to FIG. 9A and FIG. 9B, in the threshold voltage sensing driving operation, the first node N1 and the second node N2 of the driving transistor DRT are initialized to a reference voltage Vref and a threshold voltage sensing driving data voltage Vdata.

Afterwards, the first node N1 of the driving transistor DRT is floated.

This consequently causes a rise in the voltage of the first node N1 of the driving transistor DRT. After the voltage has risen for a predetermined period of time, the growth rate of the voltage of the first node N1 of the driving transistor DRT gradually decreases, and the voltage is saturated.

The saturated voltage of the first node N1 of the driving transistor DRT may correspond to the difference between the data voltage Vdata and the threshold voltage Vth or the difference between the data voltage Vdata and the threshold voltage difference ΔVth.

When the voltage of the first node N1 of the driving transistor DRT is saturated, the sensor 810 senses the saturated voltage of the first node N1 of the driving transistor DRT.

The voltage Vsense sensed by the sensor 810 may be a voltage Vdata-Vth obtained by deducting the threshold voltage Vth from the data voltage Vdata or a voltage Vdata-ΔVth obtained by deducting the threshold voltage difference ΔVth from the data voltage Vdata.

Figure 10A:
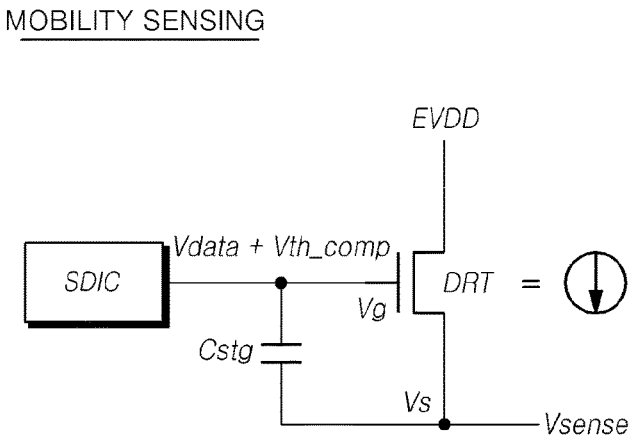
FIG. 10A and FIG. 10B are a circuit diagram and a graph illustrating a mobility sensing method for a driving transistor in the OLED display device according to the present embodiments.
Figure 10B:
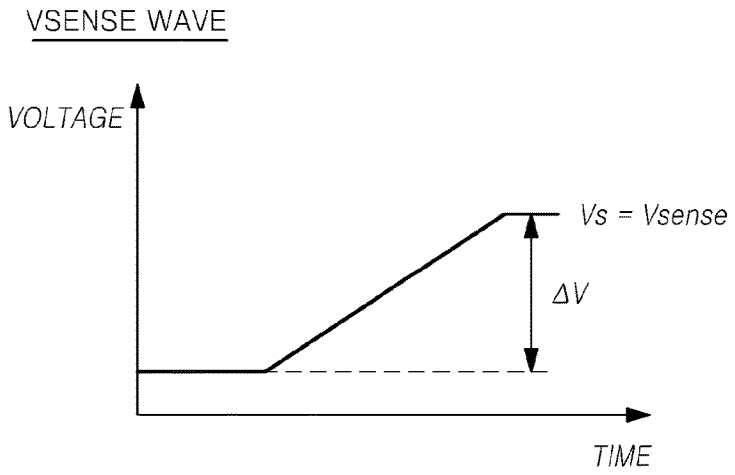

FIG. 10A and FIG. 10B are a circuit diagram and a voltage graph illustrating a mobility sensing method for the driving transistor DRT in the OLED display panel 100 according to the present embodiments.

Referring to FIG. 10A and FIG. 10B, in a mobility sensing operation, the first node N1 and the second node N2 of the driving transistor DRT are initialized to a reference voltage Vref and a mobility sensing driving data voltage Vdata.

Afterwards, the first node N1 of the driving transistor DRT is floated.

This consequently causes a rise in the voltage of the first node N1 of the driving transistor DRT.

The rate at which the voltage of the first node N1 of the driving transistor DRT rises (an amount of change in voltage rise per time ΔAV) indicates the current capability of the driving transistor DRT, i.e. the mobility of the driving transistor DRT. The greater the current capability (mobility) of the driving transistor DRT is, the more sharply the voltage of the first node N1 of the driving transistor DRT rises.

After the voltage has risen for a predetermined period of time, the sensor 810 senses the risen voltage of the first node N1 of the driving transistor DRT, i.e. the voltage of the reference voltage line RVL that has risen following the rise in the voltage of the first node N1 of the driving transistor DRT.

Referring to FIG. 8, as the threshold voltage or mobility sensing driving operation is performed as described above, the sensor 810 digitizes the voltage Vsense sensed for threshold voltage sensing or mobility sensing, generates sensing data including the converted digital value, and outputs the generated sensing data.

The sensing data output by the sensor 810 may be stored in the memory 360 or may be provided to the compensator 390.

The compensator 390 may acquire the characteristics (e.g. a threshold voltage or mobility) or changes in the characteristics (e.g. changes in the threshold voltage or mobility) of the driving transistor DRT in corresponding subpixels, based on the sensing data stored in the memory 360 or provided by the sensor 810, and may perform a characteristics compensation process.

Here, changes in the characteristics of the driving transistor DRT may mean that sensing data has been changed from previous sensing data or reference sensing data.

Here, differences in characteristics between driving transistor DRT may be obtained by comparing the characteristics between the driving transistors DRT or changes in the characteristics of the driving transistors DRT. When changes in the characteristics of driving transistor DRT mean that the sensing data has been changed from the reference sensing data, the differences in characteristics between the driving transistors DRT (i.e. differences in luminance between subpixels) may be obtained from the changes in the characteristics of the driving transistors DRT.

The characteristics compensation process may include threshold voltage compensation to compensate for the threshold voltages of the driving transistors DRT and mobility compensation to compensate for the degrees of mobility of the driving transistors DRT.

The threshold voltage compensation may include calculating compensation values related to compensation for threshold voltages or differences in threshold voltages (changes in threshold voltages) and storing the calculated compensation values in the memory 360, and may include changing corresponding image data based on the calculated compensation values.

The mobility compensation may mean the process of calculating compensation values related to compensation for mobility or mobility differences (changes in mobility) and storing the calculated compensation values in the memory 360, and may include changing corresponding image data using the calculated compensation values.

The compensation values (threshold voltage compensation values) calculated in the threshold voltage compensation and the compensation values (mobility compensation values) calculated in the mobility compensation are collectively referred to as "transistor compensation factors" or "transistor compensation values."

The compensator 390 may change image data through the threshold voltage compensation or the mobility compensation and provide the changed data to a corresponding SDIC in the data driver 320.

Then, the corresponding SDIC converts the changed data into data voltages through a digital-to-analog converter (DAC) 820 and provides the converted data (data voltages) to corresponding subpixels, such that subpixel characteristics compensation (threshold voltage compensation or mobility compensation) may be actually performed.

The subpixel characteristics compensation performed as above may reduce or remove differences in luminance between subpixels, thereby improving image quality.

As set forth above, the present embodiments provide the remote compensation service method, the remote compensation service system, the OLED display device 10, and the remote compensation server 20, in which the remote compensation server can perform the compensation function to compensate for changes in element characteristics (e.g. changes in threshold voltages) due to degradations in circuit elements (e.g. OLEDs) in the OLED display panel 100 on behalf of the OLED display device 10.

In addition, the present embodiments provide the remote compensation service method, the remote compensation service system, the OLED display device 10, and the remote compensation server 20, in which the remote compensation server 20 can perform the compensation function to compensate for changes in element characteristics due to degradations in circuit elements in the OLED display panel 100 on behalf of the OLED display device 10, thereby reducing the processing load of the OLED display device 10 regarding the compensation function.

Furthermore, the present embodiments provide the remote compensation service method, the remote compensation service system, the OLED display device 10, and the remote compensation server 20, in which the remote compensation server 20 having higher processing performance than the OLED display device 10 can perform the compensation function for the OLED display panel 100, thereby enabling more accurate compensation.

In addition, the present embodiments provide the remote compensation service method, the remote compensation service system, the OLED display device 10, and the remote compensation server 20, in which the remote compensation server 20 can perform the compensation function for the OLED display panel 100 on behalf of the OLED display device 10, thereby removing requirements for the design of additional components and the design of high processing components in relation to the compensation function performed by the OLED display device 10.

Furthermore, according to the present embodiments, when the OLED display device 10 for a remote compensation service is a mobile device, such as a smartphone or a tablet PC, a variety of operations that the OLED display device 10 or the remote compensation server 20 executes to perform the remote compensation service may be embodied as a computer program.

The computer program may be programmed as codes and segments executed by a computing device, such as the OLED display device 10 and/or the remote compensation server 20, such that a variety of operations for a remote compensation service can be executed by the OLED display device 10.

The computer program may be written in a storage medium in the form of instructions executable by a computing device, such as the OLED display device 10 and/or the remote compensation server 20.

The storage medium readable by a computing device, in which an application or a computer program for executing the remote compensation service according to the present embodiments is written, may be an application store server, an application provider server including a web server or the like related to the application or the corresponding service, a storage medium included therein, or another computer or a storage medium thereof in which the computer program is written.

The application or computer program for executing the remote compensation service according to the present embodiments may be installed in the OLED display device 10, which can be embodied as a smartphone, a tablet PC, a PDA, a mobile communication terminal, or the like, after being downloaded from the application server or the application provider server including a web server or the like. In some cases, after the application or computer program is downloaded from the application provider server to a common PC, the application or computer program may be installed in the OLED display device 10 using a synchronization program.

The foregoing descriptions and the accompanying drawings have been presented in order to explain the certain principles of the present disclosure. A person skilled in the art to which the disclosure relates can make many modifications and variations by combining, dividing, substituting for, or changing the elements without departing from the principle of the disclosure. The foregoing embodiments disclosed herein shall be interpreted as illustrative only but not as limitative of the principle and scope of the disclosure. It should be understood that the scope of the disclosure shall be defined by the appended Claims and all of their equivalents fall within the scope of the disclosure.

What is claimed is:

1. A method of compensating for changes in characteristics of a panel of a display device, the panel including a plurality of subpixels, each of the plurality of subpixels including an organic light emitting diode, the method comprising:

counting, by the display device, at least one on-time of at least one subpixel of the plurality of subpixels, the at least one on-time indicating a number of occurrences of light emitted by the at least one subpixel;

transmitting, by the display device, the at least one on-time to a remote compensation server through a network;

receiving, by the remote compensation server from the display device through the network, product identification information or panel identification information;

selecting, by the remote compensation server, an organic light emitting diode degradation look up table from amongst a plurality of organic light emitting diode degradation look up tables based on the product identification information or the panel identification information;

determining, by the remote compensation server, an organic light emitting diode compensation factor by applying the at least one on-time to the organic light emitting diode degradation look up table;

transmitting, by the remote compensation server, the organic light emitting diode compensation factor to the display device through the network; and driving, by the display device, the panel based on the organic light emitting diode compensation factor.

2. The method of claim 1, further comprising:

sensing, by the display device, a voltage or current;

generating, by the display device, sensing data indicative of a characteristic of the at least one subpixel based on the sensed voltage or the sensed current;

transmitting, by the display device, the sensing data to the remote compensation server through the network;

determining, by the remote compensation server, a transistor compensation factor based on the sensing data;

transmitting, by the remote compensation server, the transistor compensation factor to the display device; and wherein the panel is driven further based on the transistor compensation factor.

3. A display device comprising:

a panel including a plurality of subpixels, each of the plurality of subpixels including an organic light emitting diode;

a counter coupled to the panel, the counter to obtain at least one on-time of at least one subpixel of the plurality of subpixels, the at least one on-time indicating a number of occurrences of light emitted by the at least one subpixel;

a communication circuit coupled to the counter and a network, the communication circuit configured to:

transmit, the at least one on-time to a remote server through the network, transmit product identification information or panel identification information to the remote server through the network, the remote server selecting an organic light emitting diode degradation look up table from amongst a plurality of organic light emitting diode degradation look up tables based on the product identification information or the panel identification information and determining an organic light emitting diode compensation factor by applying the at least one on-time to the organic light emitting diode degradation look up table, and receive, the organic light emitting diode compensation factor through the network;

a compensator circuit coupled to the communication circuit, the compensator circuit configured to generate compensated image data based on the organic light emitting diode compensation factor; and a driver circuit coupled to the compensator circuit and the panel, the driver configured to drive the panel based on the compensated image data.

4. The display device of claim 3, wherein the at least one on-time indicates the number of occurrences of light emitted by the at least one subpixel for a gray level.

5. The display device of claim 3, wherein the compensator circuit is configured to generate the compensated image data based on the organic light emitting diode compensation factor to compensate for a change in a threshold voltage of the organic light emitting diode.

6. The display device of claim 3, further comprising:

a sensor coupled to the plurality of subpixels, the sensor configured to generate sensing data indicative of a characteristic of the at least one subpixel, wherein the communication circuit is further configured to:

transmit the sensing data to the remote server through the network, and receive a transistor compensation factor through the network, the transistor compensation factor generated by the remote server based on the sensing data, and wherein the compensator circuit is configured to generate the compensated image data further based on the transistor compensation factor.

7. The display device of claim 6, wherein the at least one subpixel includes a driving transistor, and wherein the compensator circuit is configured to generate the compensated image data further based on the transistor compensation factor to compensate for a change in a threshold voltage or a mobility of the driving transistor.

8. The display device of claim 7, wherein the driving transistor supplies current to the organic light emitting diode of the at least one subpixel for emitting light.

9. The display device of claim 8, wherein the sensor is configured to sense a saturated voltage of an electrode of the driving transistor changing from a reference voltage, wherein the sensing data includes a value of the saturated voltage indicative of the threshold voltage of the driving transistor.

10. The display device of claim 8, wherein the sensor is configured to sense a voltage of an electrode of the driving transistor for a predetermined amount of time after a reference voltage is provided to the electrode, wherein the sensing data includes a value of the sensed voltage, a rate of change from the reference voltage to the sensed voltage indicative of the mobility of the driving transistor.

11. The display device of claim 3, further comprising a memory coupled to the communication circuit, the memory to store the organic light emitting diode compensation factor.

12. A method performed by a remote server for compensating for changes in characteristics of a panel in a display device through a network, the panel including a plurality of subpixels, each of the plurality of subpixels including an organic light emitting diode, the method comprising:

receiving, from the display device and through the network, at least one on-time of a subpixel of the plurality of subpixels, the at least one on-time indicating a number of occurrences of light emitted by the subpixel;

receiving from the display device and through the network, product identification information or panel identification information;

selecting an organic light emitting diode degradation look up table from amongst a plurality of organic light emitting diode degradation look up tables based on the product identification information or the panel identification information;

determining an organic light emitting diode compensation factor by applying the at least one on-time to the organic light emitting diode degradation look up table; and transmitting the organic light emitting diode compensation factor to the display device through the network.

13. The method of claim 12, wherein the at least one on-time indicates the number of occurrences of light emitted by the at least one subpixel for a gray level.

14. The method of claim 12, wherein the organic light emitting diode compensation factor indicates an amount of compensation corresponding to a change in a threshold voltage of the organic light emitting diode of the subpixel.

15. The method of claim 12, further comprising:

receiving sensing data indicative of a characteristic of a driving transistor of the subpixel through the network;

determining a transistor compensation factor based on the sensing data; and transmitting the determined transistor compensation factor to the display device.

16. The method of claim 15, wherein the transistor compensation factor transmitted to the display device indicates an amount of compensation corresponding to a change in a threshold voltage or a mobility of the driving transistor.

17. The method of claim 16, wherein the driving transistor supplies current to the organic light emitting diode of the subpixel for emitting light.

* * * * *